US008689754B2

(12) United States Patent
Christgen et al.

(10) Patent No.: US 8,689,754 B2
(45) Date of Patent: Apr. 8, 2014

(54) ASSEMBLY FOR A VALVE DRIVE OF AN INTERNAL COMBUSTION ENGINE

(75) Inventors: Wolfgang Christgen, Seukendorf (DE); Peter Sailer, Erlangen (DE); Frank Himsel, Obermichelbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 153 days.

(21) Appl. No.: 13/394,895

(22) PCT Filed: Jul. 29, 2010

(86) PCT No.: PCT/EP2010/061012

§ 371 (c)(1),
(2), (4) Date: Mar. 8, 2012

(87) PCT Pub. No.: WO2011/029667

PCT Pub. Date: Mar. 17, 2011

(65) Prior Publication Data

US 2012/0167847 A1 Jul. 5, 2012

(30) Foreign Application Priority Data

Sep. 8, 2009 (DE) ..... 10 2009 040 608

(51) Int. Cl.
*F01L 1/14* (2006.01)

(52) U.S. Cl.
USPC ..... 123/90.5; 123/90.43; 123/90.48; 123/90.45; 123/90.52

(58) Field of Classification Search
USPC ..... 123/90.16, 90.36, 90.39–90.59; 74/559; 29/888.2
See application file for complete search history.

(56) References Cited

U.S. PATENT DOCUMENTS

| | | | | |
|---|---|---|---|---|
| 5,775,280 | A * | 7/1998 | Schmidt et al. | 123/90.41 |
| 6,047,675 | A * | 4/2000 | Kunz | 123/90.41 |
| 6,543,402 | B2 | 4/2003 | Burns | |
| 7,350,489 | B2 * | 4/2008 | Engelhardt et al. | 123/90.39 |
| 7,350,490 | B2 * | 4/2008 | Mock et al. | 123/90.39 |
| 7,721,695 | B2 * | 5/2010 | Moeck et al. | 123/90.39 |
| 7,975,664 | B2 * | 7/2011 | Himsel et al. | 123/90.27 |
| 2005/0183686 | A1 | 8/2005 | Fuji | |
| 2011/0011361 | A1 * | 1/2011 | Roberts | 123/90.55 |
| 2011/0017160 | A1 * | 1/2011 | Kishi et al. | 123/90.45 |

FOREIGN PATENT DOCUMENTS

| | | | |
|---|---|---|---|
| CN | 1525050 | A | 9/2004 |
| CN | 101010491 | A | 8/2007 |
| DE | 2350520 | A1 | 4/1975 |
| DE | 196 17 523 | A1 | 11/1997 |

(Continued)

*Primary Examiner* — Thomas E. Denion
*Assistant Examiner* — Daniel Bernstein
(74) *Attorney, Agent, or Firm* — Lucas & Mercanti, LLP

(57) ABSTRACT

An assembly for a valve drive of an internal combustion engine, which has a hydraulic support element and a cam follower connected by way of a clamp. The follower rests on one end via a cap on a spherical head of a pressure piston of the support element. The piston extends in a bore of a housing of the support element. The clamp flanks the cap with holding strips along the sides. The inner sides run in a guide zone on the outer shell of the piston. The housing has an opening for hydraulic fluid that can be conducted between the housing and the piston through at least one passage in the piston to a storage chamber. The guide zone on the piston is also designed as an anti-rotation mechanism therefore. The piston is installed in a defined manner and is torsionally oriented in relation to the cam follower.

11 Claims, 1 Drawing Sheet

(56) References Cited

FOREIGN PATENT DOCUMENTS

| | | | |
|---|---|---|---|
| DE | 102 49 560 | A1 | 5/2004 |
| DE | 10 2005 010 750 | A1 | 9/2006 |
| WO | 2006/021300 | A1 | 3/2006 |

* cited by examiner

ASSEMBLY FOR A VALVE DRIVE OF AN INTERNAL COMBUSTION ENGINE

CROSS-REFERENCE TO RELATED APPLICATIONS

This application is a 371 of PCT/EP2010/061012 filed Jul. 29, 2010, which in turn claims the priority of DE 10 2009 040 608.5 filed Sep. 8, 2009. The priority of both applications is hereby claimed and both applications are incorporated by reference herein.

FIELD OF THE INVENTION

The invention relates to an assembly for a valve drive of an internal combustion engine, which has a hydraulic supporting element and a drag lever that is connected to the hydraulic supporting element via a bracket.

BACKGROUND OF THE INVENTION

With respect to the prior art, reference is made to documents DE 196 17 523 C2 (bracket made from longitudinally extending sheet metal strip), DE 102 49 560 A1 (bracket made from transversely extending sheet metal strip) and U.S. Pat. No. 6,543,402 B2 (wire bracket). The pressure piston of the hydraulic supporting element of the respective assembly runs in its housing in a freely rotationally movable manner. A passage in the corresponding pressure piston therefore lies during operation at any desired rotational position with respect to the housing and ultimately also longitudinally in the region of tensile or compressive stresses which are introduced via the head of the pressure piston during cam loading of the resting drag lever. In the section of the corresponding passage, the forces which are introduced can lead to stress peaks which destroy components. In order to counteract the former, the elements optionally have to have thicker dimensions or the maximum rotational speed to be used is to be reduced.

Moreover, in the case of an installation of a respective assembly in a cylinder head with a receptacle for the supporting element, which receptacle extends obliquely with respect to the perpendicular, it occurs that, in the unfavorable case of the latter (passage "lying at the bottom"), the storage space of said supporting element is undesirably emptied of hydraulic medium, with the result that air may be sucked into a high pressure space of the hydraulic play compensation apparatus.

SUMMARY OF THE INVENTION

It is therefore an object of the invention to provide an assembly, in which component the disadvantages indicated are eliminated.

Broadly, the invention relates to an assembly for a valve drive of an internal combustion engine, which comprises a hydraulic supporting element and a drag lever, which is connected to the hydraulic supporting element via a bracket and is seated at one end via a spherical cap in its underside on a spherical head of a pressure piston of the supporting element. The pressure piston runs via its outer shell in a bore of a cup-like housing of the supporting element. The bracket flanks the spherical cap longitudinally with holding strips, the inner sides of which run in a guide zone on the outer shell of the pressure piston. The housing has a duct for hydraulic medium, which can be guided via a channel between the housing and the pressure piston to at least one passage in the pressure piston to a storage space in the pressure piston.

According to the invention, this object is achieved in that the guide zone on the pressure piston is at the same time configured as an anti-rotation safeguard for said pressure piston, the pressure piston being installed in a rotationally oriented manner in a defined way with respect to the drag lever.

A component is therefore present, in which the disadvantages which are cited in the introduction are no longer to be expected. The duct in the pressure piston is therefore "compulsorily" positioned outside a region of stress peaks during operation and lies in the region of a bevel which is free of stress, as it were. A destruction of components as a result of undesirable stress peaks in the duct region is no longer to be expected.

Inter alia, two flats or depressions which lie diametrically opposite one another and the connecting line of which extends orthogonally with respect to the lever longitudinal axis are considered as guide zone for inner sides of the holding strip of the respective bracket. According to one expedient concrete embodiment of the invention, the flats/depressions can be punched, for example.

During mounting of the assembly, accordingly, the pressure piston of the supporting element has to be mounted/clipped in a "directed" manner with its guide zone behind the holding strips of the bracket, with the result that the corresponding passage lies laterally in the virtually stress-free region. For the "oblique installation variant," the passage has to assume a geodetically high position during installation. The housing preferably remains rotationally movable with respect to the pressure piston, but can also be rotationally fixed with respect to the latter.

For example, a component made from sheet metal, the end projections of which extend either longitudinally or transversely, is considered as bracket. As an alternative, the bracket with its holding strips can also consist of wire. What is important in this context is a free pivoting movability of the drag lever on the head of the supporting element, which movability is not impaired by the bracket.

Simple measures for feeding the hydraulic medium to the storage space in the pressure piston are the subject matter of a further subclaim. According to said subclaim, starting from at least one duct in the housing, an annular groove tap in the region of an interface between the pressure piston and the housing is preferably considered. The at least one duct and the at least one passage are preferably produced as bores, windows or the like also being considered.

DETAILED DESCRIPTION OF THE INVENTION

Figure 1:
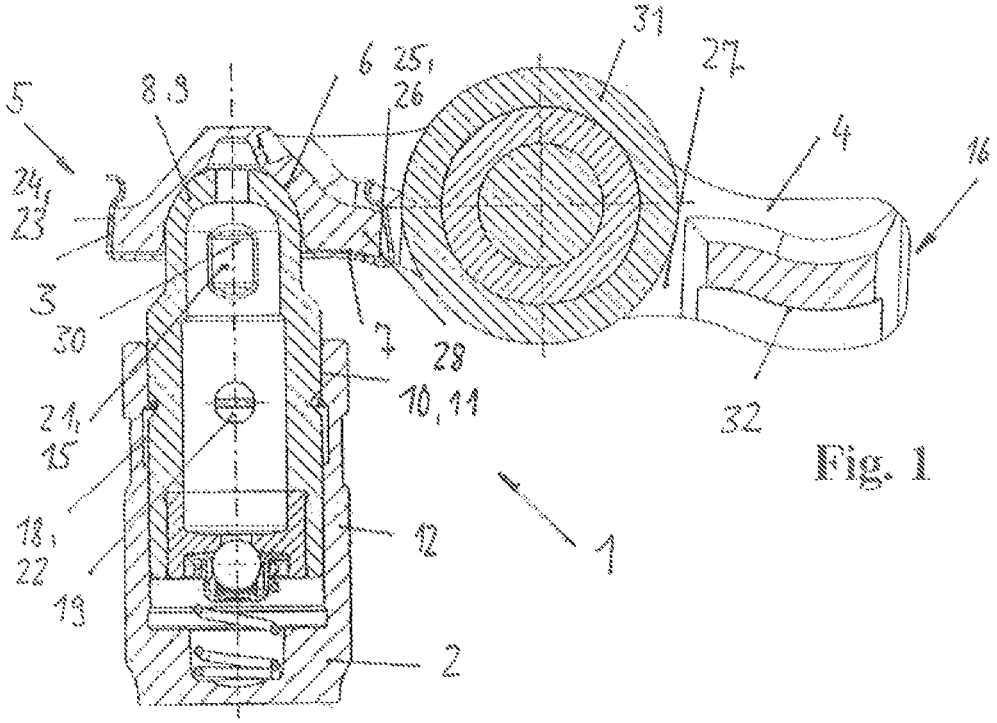
FIG. 1 shows a longitudinal section through the assembly.
Figure 2:
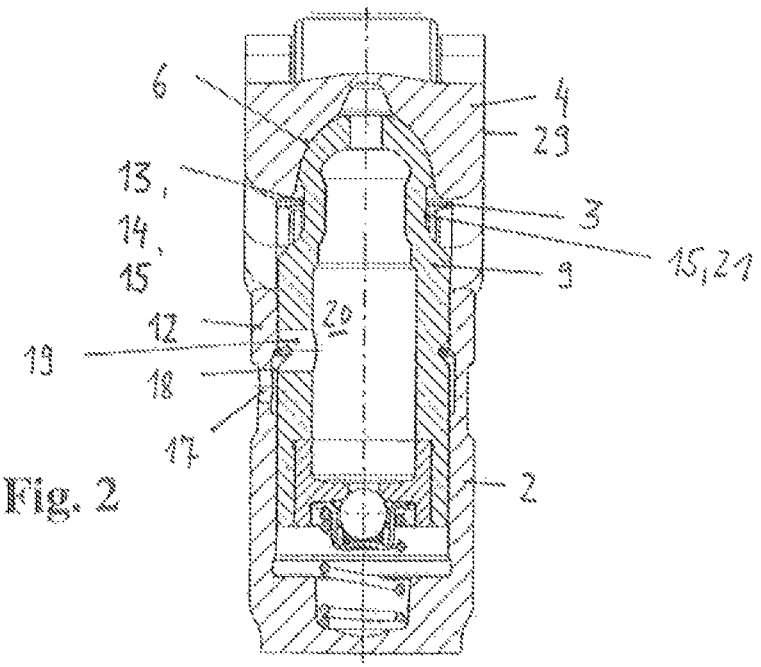
FIG. 2 shows a cross-section through the assembly in the region of its supporting element.

An assembly 1 for a valve drive of an internal combustion engine is shown. It is formed from a hydraulic supporting element 2 and a drag lever 4 which is connected to said supporting element 2 via a bracket 3. Said drag lever 4 is seated at one end 5 via a spherical cap 6 which is situated in its underside 7 on a spherical head 8 of a pressure piston 9 of the supporting element 2. The pressure piston 9 runs via its outer shell 10 in a bore 11 of a cup-like housing 12 of the supporting element 2. At the other end 16, the drag lever 4 has a rest 32 on the underside 7 for a stem of a as exchange valve.

The housing 12 has a duct 17 (bore) for hydraulic medium which can be guided via a channel 18 (annular groove tap) between the housing 12 and the pressure piston 9 to the passage 19 (bore) in the pressure piston 9 and from there to a storage space 20 in said pressure piston 9.

The abovementioned bracket 3 flanks the spherical cap 6 longitudinally with two holding strips 13. Inner sides 14 run in a guide zone 15 on the outer shell 10 of the pressure piston 9. The guide zone 15 consists of two flats 21 which lie transversely opposite one another in the vicinity of the head on the outer shell 10 of the pressure piston 9. The flats 21 have two shoulders 30 which lie opposite one another in the axial direction.

Via the engagement of the holding strips 13 into the guide zone 15, the pressure piston 9 is not only connected in an articulated manner to the drag lever 4 in a simple way, but rather is also secured rotationally with respect to the drag lever 4.

The passage 19 therefore, lies "compulsorily" in the neutral region of the pressure piston 9, which region is stress-free, as it were. A risk of fracture after long term loading during operation is eliminated. Components, which are configured with thinner walls than previously, can optionally be used.

The bracket 3 extends longitudinally with its holding strips 13 on the underside 7 of the drag lever 4. An end projection 23 of the bracket 3 is bent at one end 5 around an end face 24 of the drag lever 4. A further end projection 25 extends around a transverse bar 26 of a cutout 27 of a transverse strut 28 of the drag lever 4 of U-shaped cross section here. A cam roller 31 is accommodated within the cutout 27, a sliding tap also being conceivable and provided.

LIST OF DESIGNATIONS

1) Assembly
2) Supporting Element
3) Bracket
4) Drag Lever
5) One End
6) Spherical Cap
7) Underside
8) Head
9) Pressure Piston
10) Outer Shell
11) Bore
12) Housing
13) Holding Strip
14) Inner Sides
15) Guide Zone
16) Other End
17) Duct
18) Channel
19) Passage
20) Storage Space
21) Flat
22) Annular Groove
23) End Projection
24) End Face
25) End Projection
26) Transverse Bar
27) Cutout
28) Transverse Strut
29) Longitudinal Wall
30) Shoulder
31) Cam Roller
32) Rest

The invention claimed is:

1. An assembly for a valve drive of an internal combustion engine, comprising:

a hydraulic supporting element, which has a cup-shaped housing and a pressure piston, the housing has a bore and a duct for a hydraulic medium, the pressure piston is arranged in the bore of the housing and has an outer shell, which runs in the bore of the housing, a spherical head, at least one passage and a storage space within the pressure piston, and the hydraulic medium can be guided via a channel between the housing and the pressure piston to the at least one passage in the pressure piston and the storage space in the pressure piston;

a bracket having holding strips with inner sides; and a drag lever, which is connected to the hydraulic supporting element via the bracket, the drag lever has a spherical cap in an underside at one end and the drag lever is seated at the one end via the spherical cap on the spherical head of the pressure piston of the supporting element, the bracket being arranged to flank the spherical cap longitudinally with the holding strips, and the inner sides of the holding strips running in a guide zone on the outer shell of the pressure piston, wherein the guide zone on the pressure piston is configured as an anti-rotation safeguard for the pressure piston, and the pressure piston is installed in a rotationally oriented manner in a defined way with respect to the drag lever.

2. The assembly as claimed in claim 1, wherein the guide zone on the pressure piston is at least one depression or flat on which the inner sides of the holding strips of the bracket are guided, and a connecting line of the depression or flat extends transversely with respect to a longitudinal axis of the lever.

3. The assembly as claimed in claim 1, wherein the guide zone on the pressure piston has two depressions or flats, which lie diametrically opposite one another and on which the inner sides of the holding strips of the bracket are guided, and a connecting line of the depressions or flats extends transversely with respect to a longitudinal axis of the lever.

4. The assembly as claimed in claim 3, wherein the depressions or flats of the pressure piston are produced by a chipless operation so that a shoulder is produced at least on a side of the pressure piston with the spherical head.

5. The assembly as claimed in claim 4, wherein chipless operation includes punching or pressing.

6. The assembly as claimed in claim 1, wherein the pressure piston is seated in the housing so that the passage of the pressure piston extends transversely with respect to a longitudinal direction of the lever.

7. The assembly as claimed in claim 1, further comprising a cylinder head of the internal combustion engine, the cylinder head having a guide hole for the supporting element, and the guide hole extends obliquely with respect to a perpendicular, wherein the pressure piston is seated in the housing in such a way that, upon installation of the supporting element in the guide hole, the passage of the pressure piston extends circumferentially at a geodetically high point.

8. The assembly as claimed in claim 1, wherein the channel between the housing and the pressure piston consists of an annular groove in the bore of the housing, and the annular groove is intersected by the duct in the housing and is fluid-connected directly to the passage in the outer shell of the pressure piston.

9. The assembly as claimed in claim 1, wherein the bracket consists of wire or sheet metal strip.

10. The assembly as claimed in claim 9, wherein the drag lever has a U-shaped cross-section and a transverse strut with a cutout that has a transverse bar, and the bracket is formed from sheet metal strip and substantially extends longitudinally with the holding strips on the underside of the drag lever, the bracket has one end projection that extends in a bent manner around an end face of the drag lever at one end of the drag lever, and a further end projection of the bracket extends in a bent manner around the transverse bar of the cutout of the transverse strut of the drag lever.

11. The assembly as claimed in claim 9, wherein the drag lever has a U-shaped cross-section and the bracket is formed from sheet metal strip and extends substantially transversely with respect to a longitudinal direction of the lever on the underside of the drag lever, and one end projection of the bracket extends in a bent manner, similar to a hoop on an outside of the drag lever, around a longitudinal wall of the drag lever.

* * * * *